US009752367B2

(12) United States Patent
Girotto et al.

(10) Patent No.: US 9,752,367 B2
(45) Date of Patent: Sep. 5, 2017

(54) DAMPING OR RETURN DEVICE FOR SLIDING DOOR LEAVES

(71) Applicant: BORTOLUZZI SISTEMI S.P.A., Belluno (IT)

(72) Inventors: Adriano Girotto, Spresiano (IT); Bruno Sponga, Belluno (IT); Lucio Moliner, Santa Giustina (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 0 days.

(21) Appl. No.: 14/889,408

(22) PCT Filed: Apr. 30, 2014

(86) PCT No.: PCT/EP2014/058817
§ 371 (c)(1),
(2) Date: Nov. 5, 2015

(87) PCT Pub. No.: WO2014/180729
PCT Pub. Date: Nov. 13, 2014

(65) Prior Publication Data

US 2016/0090770 A1 Mar. 31, 2016

(30) Foreign Application Priority Data

May 9, 2013 (IT) ..... TV2013A0072

(51) Int. Cl.
*A47B 95/02* (2006.01)
*E05F 5/00* (2017.01)
(Continued)

(52) U.S. Cl.
CPC ..... *E05F 5/003* (2013.01); *A47B 96/00* (2013.01); *E05D 13/10* (2013.01);
(Continued)

(58) Field of Classification Search
CPC .. E05F 3/00; E05F 3/003; E05D 13/10; E05D 15/0643; E05D 15/0652; E05D 2015/0695; A47B 96/00
See application file for complete search history.

(56) References Cited

U.S. PATENT DOCUMENTS 8,915,019 B2 * 12/2014 Schachter ..... E05F 5/003 16/82
2007/0186481 A1 * 8/2007 Tomita ..... A47B 88/0477 49/409

(Continued)

FOREIGN PATENT DOCUMENTS

CN 202249510 U 5/2012
CN 202810449 U 3/2013

(Continued)

OTHER PUBLICATIONS

International Search Report and Written Opinion of corresponding PCT/EP2014/058817; mailed Jun. 11, 2014; 10 pages.

(Continued)

*Primary Examiner* — Hanh V Tran
(74) *Attorney, Agent, or Firm* — Brooks Kushman P.C.

(57) ABSTRACT

A damping or return device for sliding door leaves, particularly for furniture, is provided. The device includes a rectilinear hollow body made of plastic material, which is slideably associated with a profile that is integral with the top of the piece of furniture and can be coupled automatically and with a snap action to an entrainer. The entainer is fixed to one of the door leaves by way of an adapted carriage. The rectilinear hollow body accommodates a bidirectional shock absorber and interacts selectively with a first or a second magnetized stroke limiting pivot which are associated with a first guide or with a second guide.

20 Claims, 9 Drawing Sheets

(51) Int. Cl.

| | |
|---|---|
| ***E05D 15/06*** | (2006.01) |
| ***A47B 96/00*** | (2006.01) |
| ***E05D 13/00*** | (2006.01) |
| ***E05F 3/00*** | (2006.01) |
| *E05D 15/08* | (2006.01) |

(52) U.S. Cl.

CPC ..... *E05D 15/0643* (2013.01); *E05D 15/0652* (2013.01); *E05F 3/00* (2013.01); *E05D 15/08* (2013.01); *E05D 2015/0695* (2013.01); *E05Y 2201/264* (2013.01); *E05Y 2600/456* (2013.01); *E05Y 2600/53* (2013.01); *E05Y 2900/20* (2013.01)

(56) References Cited

U.S. PATENT DOCUMENTS

2010/0293859 A1* 11/2010 Nezu ..... E05B 65/0858 49/358
2011/0167588 A1* 7/2011 Chang ..... E05F 5/003 16/71
2012/0019012 A1* 1/2012 Saito ..... E05B 65/0858 292/68
2013/0056306 A1* 3/2013 Lee ..... B66B 13/24 187/314

FOREIGN PATENT DOCUMENTS

| | | | |
|---|---|---|---|
| EP | 1658785 | A1 | 5/2006 |
| EP | 2330269 | A2 | 6/2011 |
| EP | 2455571 | A1 | 5/2012 |
| EP | 2557259 | A2 | 2/2013 |

OTHER PUBLICATIONS

Search Report of corresponding Italian application No. IT TV20130072; dated Dec. 20, 2013; 2 pages.
First Office Action of corresponding Chinese Patent Application No. 201480025876; dated Aug. 2, 2016; 7 pages.

* cited by examiner

DAMPING OR RETURN DEVICE FOR SLIDING DOOR LEAVES

This application is the U.S. national phase of PCT Application No. PCT/EP2014/058817 filed Apr. 30, 2014, which claims priority to Italian Application No. TV2013A000072 filed May 9, 2013, the disclosures of which are incorporated in their entirety by reference herein.

The present invention relates to a damping or return device for sliding door leaves, of the type with co-planar closure or otherwise, particularly for furniture and the like.

Nowadays as an alternative to normal, hinged doors, solutions are known for sliding doors that can be applied both to cabinets and pieces of furniture in general, and also to door and window frames or to any other application of closing elements that require a reduced space when open.

In general such types of door are constituted by one or more door leaves, each one of which has brackets with rolling means that are guided by a rail, which is constituted by an upper guide and by a lower guide, which respectively are applied to the ceiling and optionally to the floor of the compartment to be closed.

It is known to fit the door leaf with a device to return it to the open position, which can be disengaged as needed when it is desired to close the sliding door, or to the closed position, when it is desired that the door leaf follow a guided closure.

A problem that is found in conventional sliding door leaves is in fact constituted by the fact that the door leaf can remain partially closed or partially open or it can slam, on the jambs of the door or on the sides of the piece of furniture, when the door leaf is completely opened or completely closed.

A partial solution to such drawback is known from EP1658785 which relates to a device that is adapted to assist and guide the movement of a door leaf, which comprises a receptacle inside which is placed a damper, a spring, an entrainment element that can be accommodated within a pair of teeth that are associated with a coupling element which comprises a guiding pivot that can slide into an upturned L-shaped guide.

The device is arranged proximate to one end of the compartment.

For example, when opening the door leaf, at a certain point the device hooks the entrainment element that activates the damper until the pivot is positioned, through the L-shaped guide, in a stable and stationary condition: when the door leaf is closed, the entrainment element interacts with the pair of teeth and activates the damper which thus gently accompanies the door until the condition where it is completely closed.

Such solution however suffers some drawbacks: the device is in fact complex in terms of construction in that it is constituted by a plurality of elements that have to be put together in advance while paying great attention to the elements of play that exist for example between the L-shaped guide and the pivot that rests in it, since any sticking or the formation of friction could defeat the operation of the device and thus prevent the correct closing or complete opening of the door leaf Furthermore, conventional return devices have other criticalities which are linked to the fact that the return spring does not have a constant force along its stroke.

This causes problems with the return along the final part of the stroke because the force is low and there are, inversely, problems with opening the door in the final part when the door is released, where the force of the spring is too high.

This, combined with the fact that the connection to the return mechanism of the door in motion occurs by way of mechanical means, creates bothersome noise in operation.

The aim of the present invention is therefore to resolve the above mentioned technical problems, eliminating the drawbacks in the cited known art and hence providing a damping or return device, which can be applied to sliding doors or door leaves, which has a simple structure that is free from sticking and makes it possible to obtain the optimal closing and guided opening of the door or of the door leaf while preventing the same from slamming against the wall of the piece of furniture.

Within this aim, an object of the invention is to provide a damping or return device that is easily applied to door leaves or to doors of conventional furniture.

Another object is to provide a damping or return device the dimensions and weight of which are contained and which thus is low cost.

Another object of the invention is to make it possible to contain the friction and elements of play in the various movements, thereby optimizing the movement and the sliding of the door leaf Another object is to provide a damping or return device that is free from bothersome noises during its operation.

This aim and these and other objects which will become better apparent hereinafter, are achieved by a damping or return device for sliding door leaves, particularly for furniture, characterized in that it is constituted by a rectilinear hollow body made of plastic material, which is slideably associated with a profile that is integral with the top of said piece of furniture and can be coupled automatically and with a snap action to an entrainer that is fixed to one of said door leaves by way of an adapted carriage, said rectilinear hollow body 8*a*, 8*b* accommodating a bidirectional shock absorber and interacting selectively with a first or a second magnetized stroke limiting pivot which are associated with a first guide or with a second guide.

Further characteristics and advantages of the invention will become better apparent from the detailed description of a particular, but not exclusive, embodiment, illustrated by way of non-limiting example in the accompanying drawings wherein.

Figure 1:
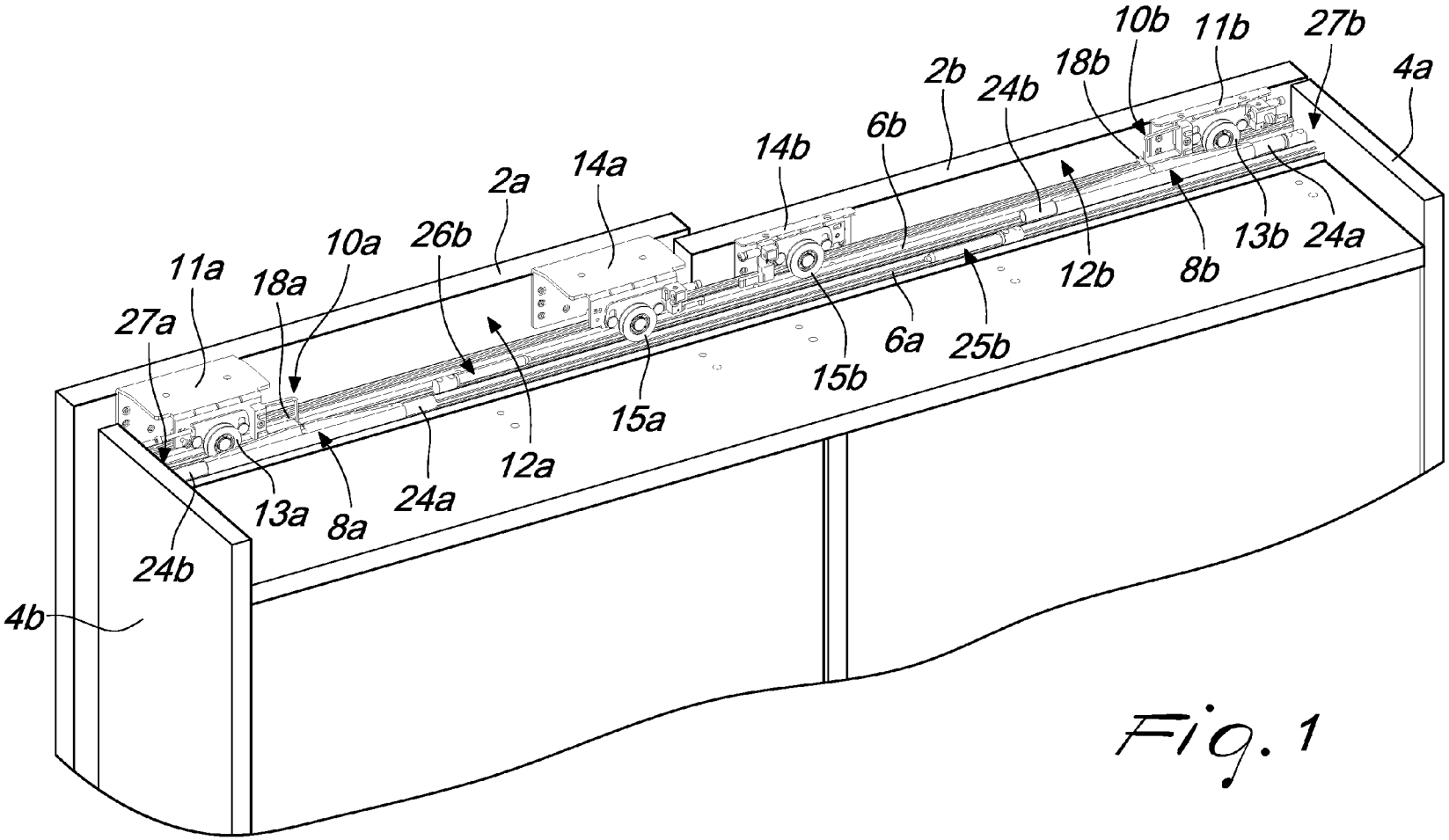
FIG. 1 is a three-quarters side view of the device applied to a cabinet with two door leaves in the closed condition.
Figure 2:
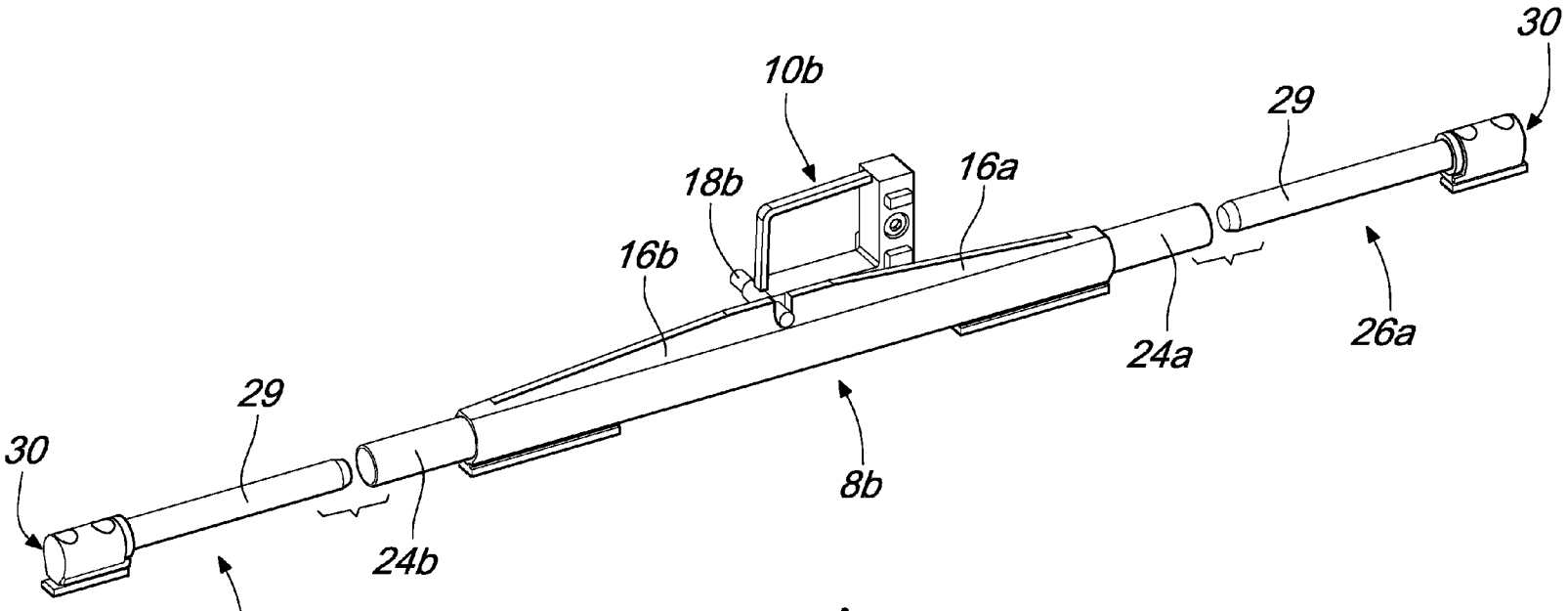
FIG. 2 is a three-quarters side view of the components the device.
Figures 3, 4:
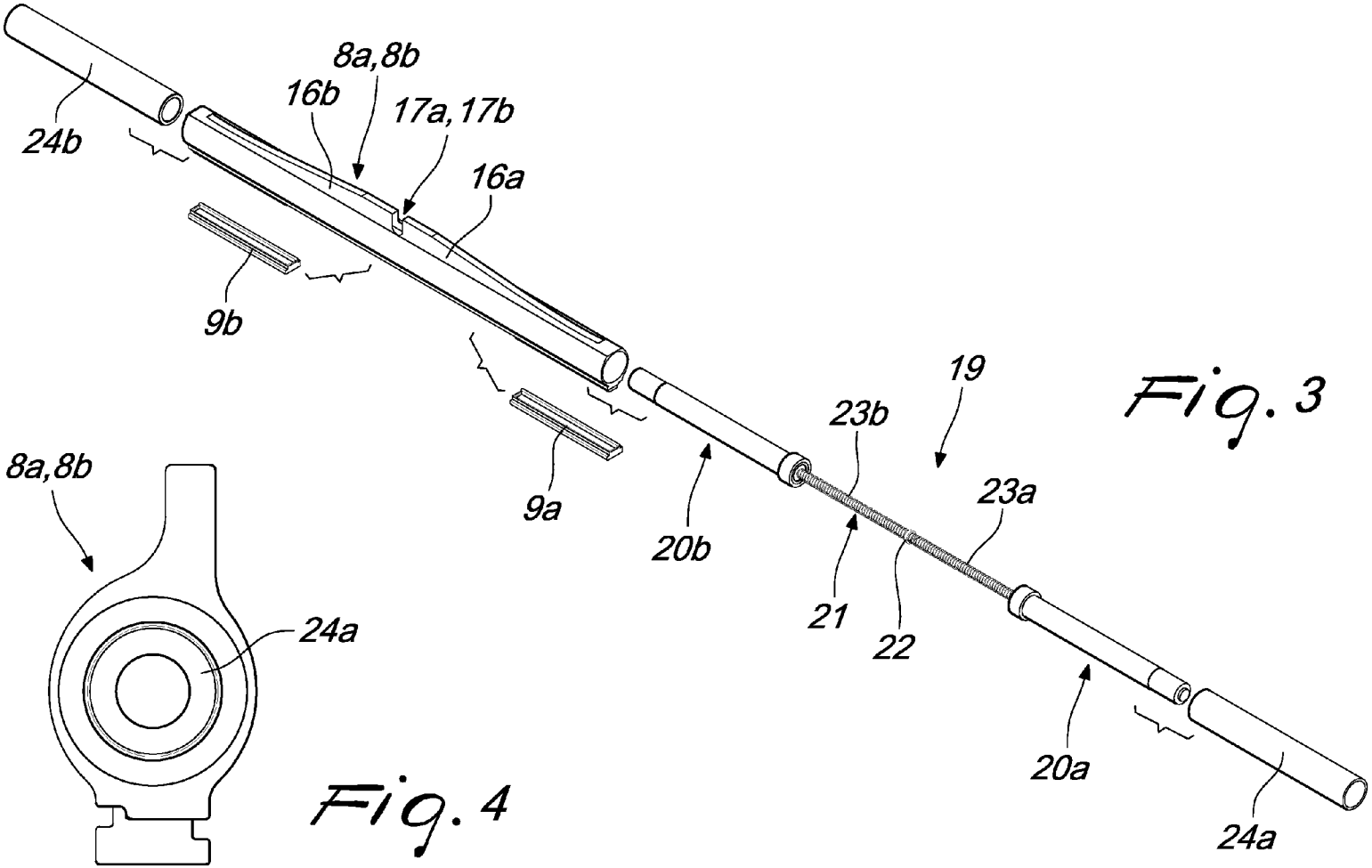
FIG. 3 is an exploded view of the device.
FIG. 4 is a front elevation view of the rectilinear hollow body.
Figure 5:
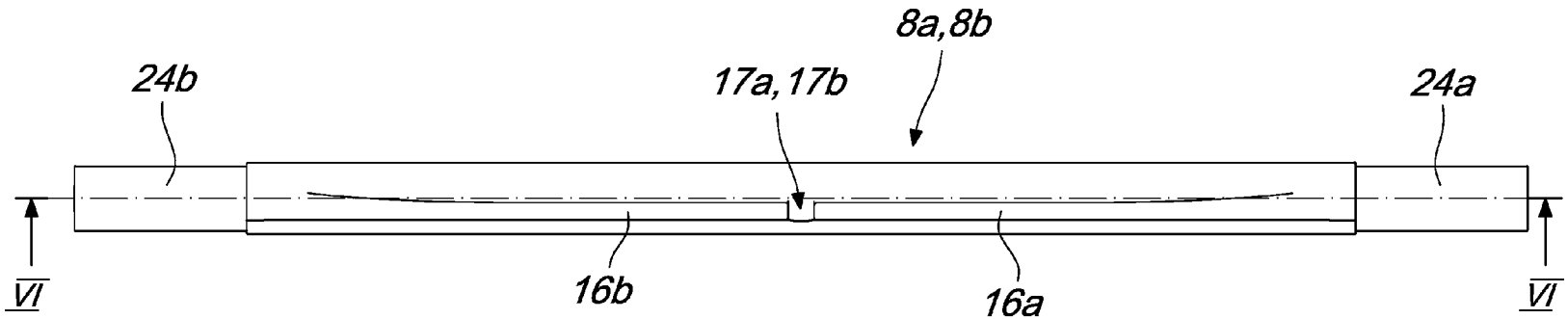
FIG. 5 is a view from above of the rectilinear hollow body.
Figure 6:
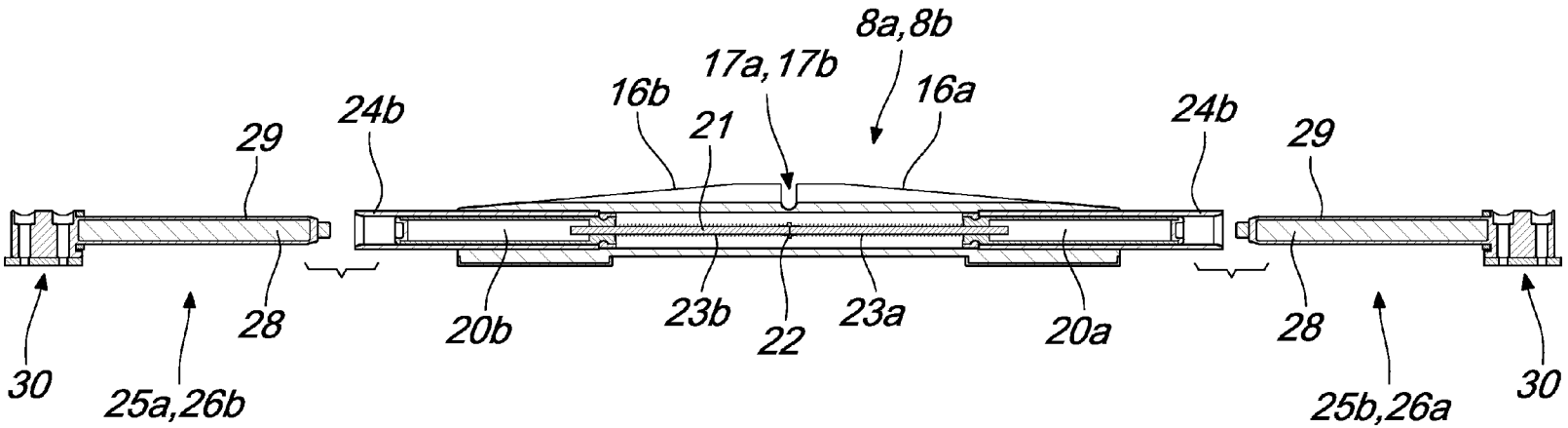
FIG. 6 is a sectional view along the line VI-VI in FIG. 5.
Figure 7:
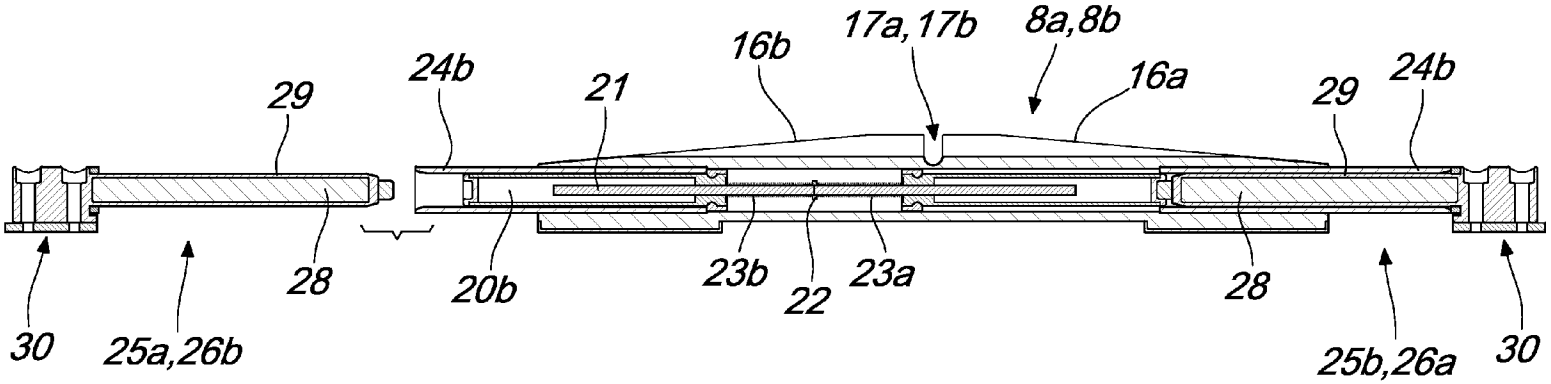
FIG. 7 is a view similar to the previous figure, in the condition in which the rectilinear hollow body interacts with a magnetized pivot.
Figure 8:
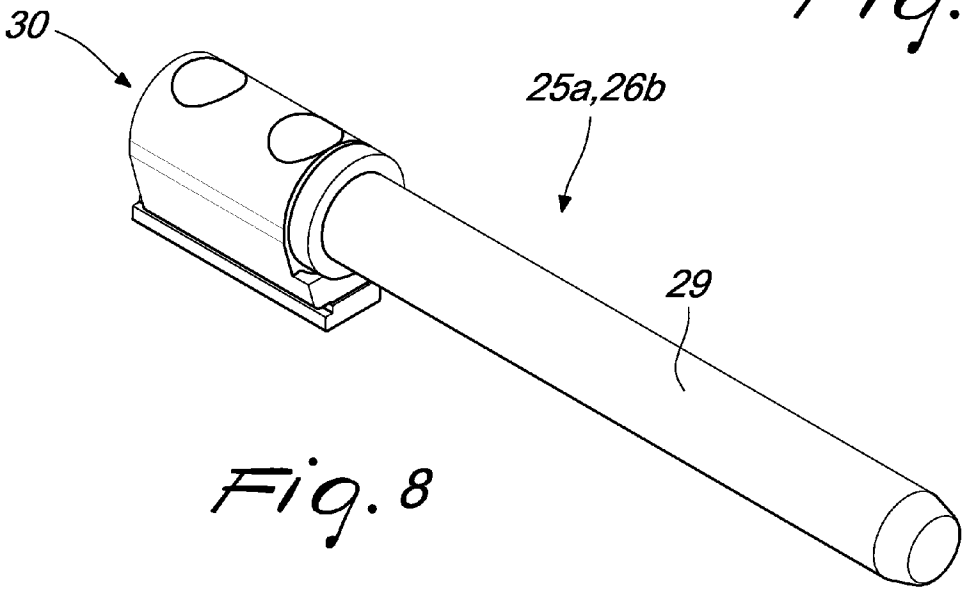
FIG. 8 is a three-quarters side view of a magnetized pivot.
Figure 9:
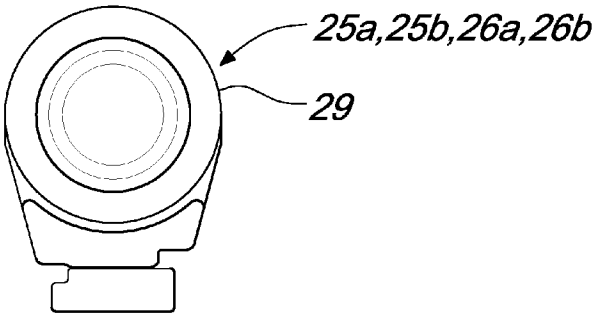
FIG. 9 is a front elevation view of a bidirectional shock absorber.
Figure 10:
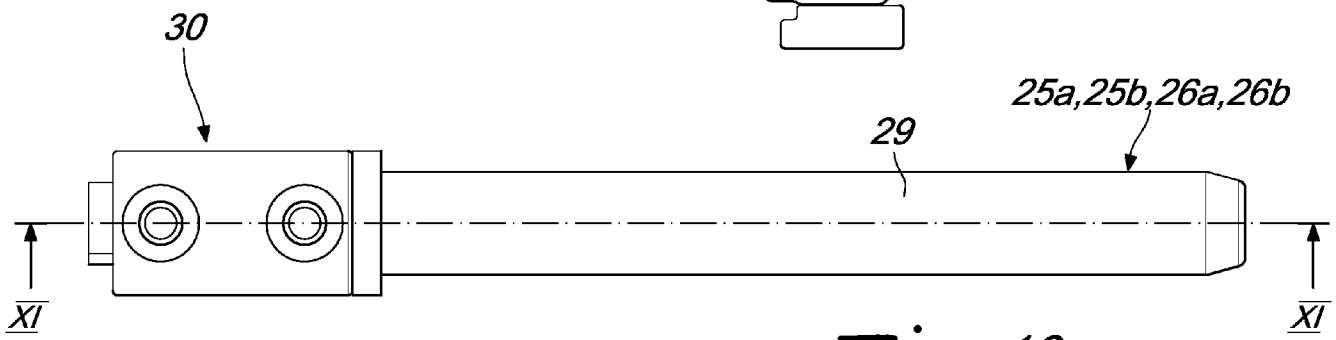
FIG. 10 is a view from above of a magnetized pivot.
Figure 11:
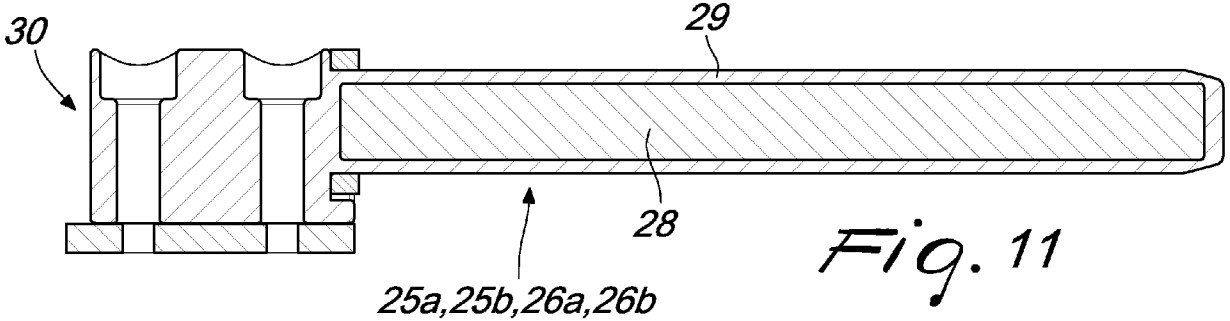
FIG. 11 is a sectional view along the line XI-XI in FIG. 10.
Figure 12:
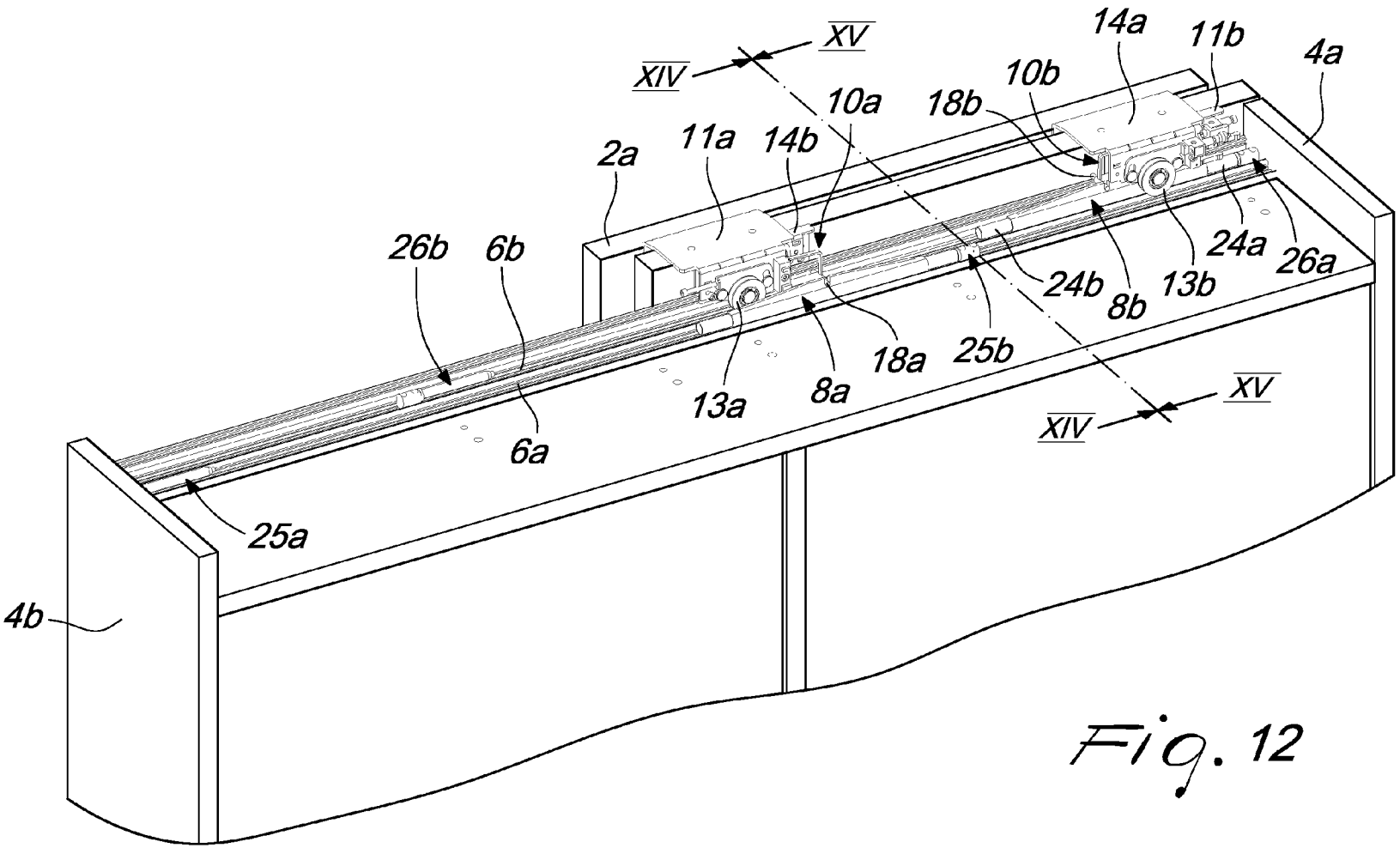
FIG. 12 is a view similar to that in FIG. 1 of the device in a first condition with the door leaves overlapped.
Figure 13:
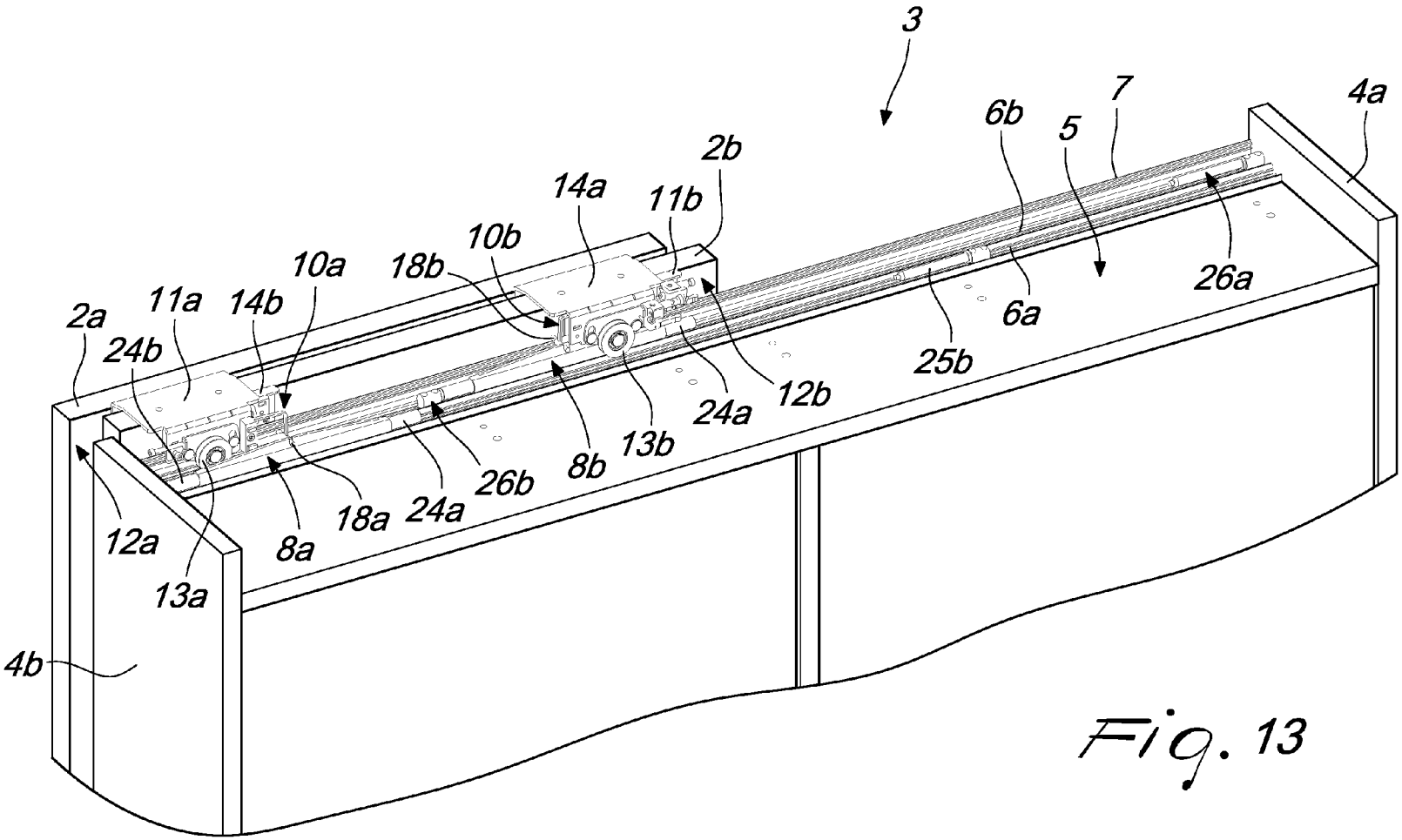
FIG. 13 is a view similar to that in FIG. 1 of the device in a second condition with the door leaves overlapped.

In the embodiments illustrated, individual characteristics shown in relation to specific examples may in reality be interchanged with other, different characteristics, existing in other embodiments.

With reference to the figures, the reference numeral 1 generally designates a device for door leaves 2*a*, 2*b* which can slide, particularly for furniture 3 and the like.

In the particular embodiment, a piece of furniture is considered which is constituted by two sides 4*a*, 4*b*, a top 5, and two door leaves 2*a*, 2*b*, which lie on mutually parallel planes in order to render them mutually overlappable.

On the top 5 there is a first guide 6*a* for the outer door leaf 2*a* and a second guide 6*b*, which is parallel to the preceding one and is arranged proximate to the front perimetric edge 7 of the top 5, for the inner door leaf 2*b*.

Figure 14:
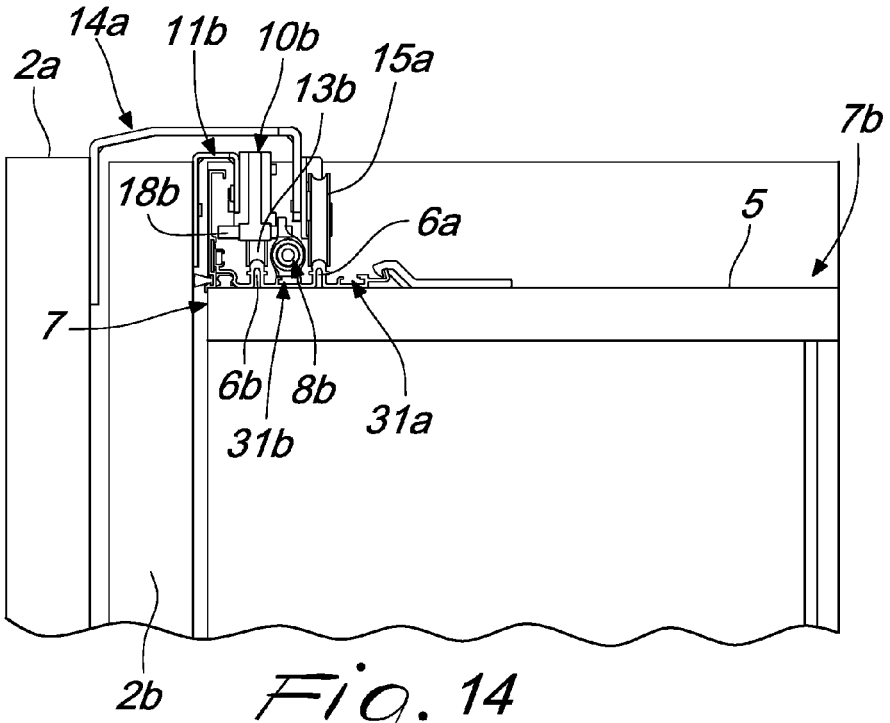
FIG. 14 is a sectional view along the line XIV-XIV in FIG. 12.
Figure 15:
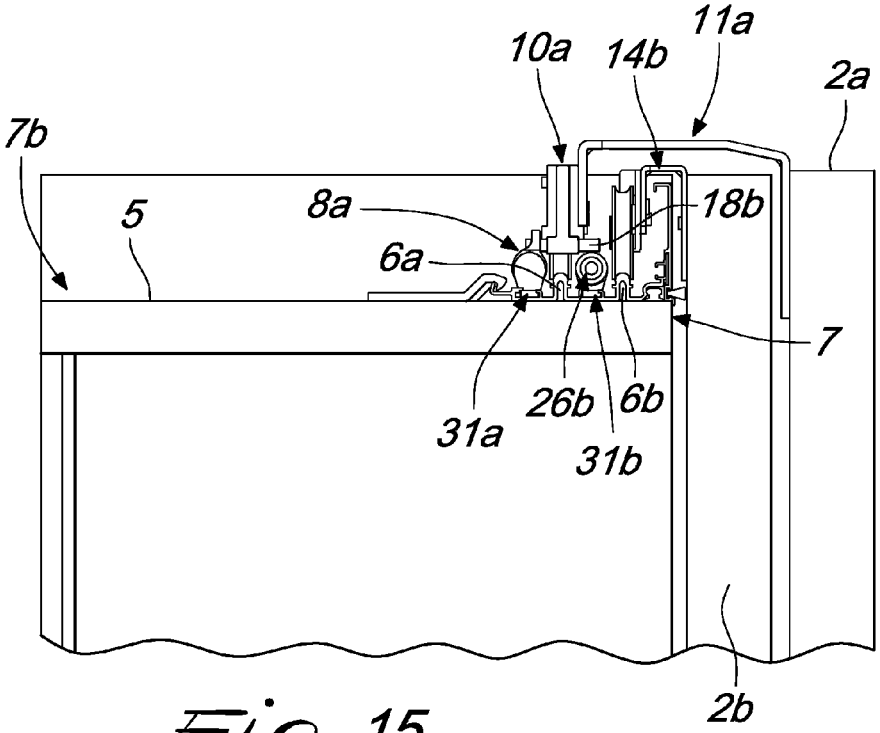
FIG. 15 is a sectional view along the line XV-XV in FIG. 12.

A device 1 is therefore associated with each door leaf, and comprises a rectilinear hollow body 8*a*, 8*b*, which is made of plastic material and is slideably associated,by way of a pair of first sliders 9*a*, 9*b*, with an adapted profile 31*a* that is arranged in a region that is intermediate between the first and second guides 6*a*, 6*b* as shown in FIG. 14, or with an adapted profile 31*b* that is arranged in a region that is adjacent to the first guide 6*a* in a direction that is opposite with respect to the front perimetric edge 7, as shown in FIG. 15.

A rectilinear hollow body 8*a* can be coupled automatically and with a snap action to an entrainer 10*a* that is fixed to said outer door leaf 2*a* by way of an adapted first carriage 11*a;* the latter is constituted by a metallic bracket that is essentially U-shaped, one of its wings being coupled proximate to the end of the inner side wall 12*a* of the outer door leaf 2*a*, and a first wheel 13*a* being associated rotatably with the other wing and sliding at the first guide 6*a*.

A second carriage 14*a* is coupled proximate to the opposite end of the inner side wall 12*a* of the outer door leaf 2*a*, and a second wheel 15*a* is associated rotatably with the other wing and slides at the first guide 6*a*.

Similarly, a rectilinear hollow body 8*b* can be coupled automatically and with a snap action to an entrainer 10*b* that is fixed to the inner door leaf 2*b* by way of an adapted first carriage 11*b;* the latter is constituted by a metallic bracket that is essentially U-shaped, one of its wings being coupled proximate to the end of the inner side wall 12*b* of the inner door leaf 2*b*, and a first wheel 13*b* being associated rotatably with the other wing and sliding at the first guide 6*b*.

A second carriage 14*b* is coupled proximate to the opposite end of the inner side wall 12*b* of the inner door leaf 2*b*, and a second wheel 15*b* is associated rotatably with the other wing and slides at the second guide 6*b*.

The rectilinear hollow body 8*a*, 8*b* has an upper profile that is shaped, in a side view, substantially like an upturned V so as to define two inclined planes 16*a*, 16*b;* at the vertex there is a first seat 17*a*, 17*b* within which it is possible to couple with a snap action a shaft 18*a*, 18*b* that protrudes transversely with respect to the entrainer 10*a*, 10*b*.

During assembly of the cabinet, by sliding the door leaf 2*a*, 2*b* which has not yet been coupled to the rectilinear hollow body 8*a*, 8*b*, the shaft 18*a*, 18*b* of each entrainer 10*a*, 10*b* intercepts the respective rectilinear hollow body 8*a*, 8*b* in order to then slide initially on the respective inclined plane 16*a*, 16*b* and thus intercept the first seat 17*a*, 17*b* by being positioned in it by snap action.

The rectilinear hollow body 8*a*, 8*b* accommodates a bidirectional shock absorber 19 that is constituted by a pair of hollow deceleration cylinders 20*a*, 20*b* that are connected axially by a pivot 21, which is partially and slideably associated therein.

The pivot 21 has, at its centerline, a disk 22 for the interposition, between the disk 22 and the facing end of the deceleration cylinders 20*a*, 20*b*, of a cylindrical helical compression spring 23*a*, 23*b*.

The dimensions of the bidirectional shock absorber 19 are such that, at rest, the deceleration cylinders 20*a*, 20*b* protrude slightly beyond the ends of the rectilinear hollow body 8*a*, 8*b*.

A metallic jacket 24*a*, 24*b* is associated coaxially with the deceleration cylinders 20*a*, 20*b* and in turn is arranged coaxially to the ends of the rectilinear hollow body 8*a*, 8*b*.

The device 1 is constituted, for each rectilinear hollow body 8*a*, 8*b*, by a first magnetized stroke limiting pivot 25*a*, 26*a* and a second magnetized stroke limiting pivot 25*b*, 26*b*.

The first magnetized pivot 25*a* and the second magnetized pivot 25*b* are associated with the profile 31*a* that is arranged in a region that is intermediate between the first and second guides 6*a*, 6*b*.

By contrast, the first magnetized pivot 26*a* and the second magnetized pivot 26*b* are associated with the profile 31*b* that is arranged in a region that is adjacent to the first guide 6*a* in a direction that is opposite with respect to the front perimetric edge 7.

The first and second magnetized pivots 25*a*, 25*b* are arranged in axial alignment with the rectilinear hollow body 8*a*, while the first and second magnetized pivots 26*a*, 26*b* are arranged in axial alignment with the rectilinear hollow body 8*b*.

The first and second stroke limiting magnetized pivots 25*a*, 25*b*, 26*a*, 26*b* are associated so that one 25*a*, 26*a* is proximate to a lateral end 27*a*, 27*b* of the piece of furniture and the other 25*b*, 26*b* is at a point that makes it possible to achieve the condition in which the door leaf is moved.

Each one of the first and second magnetized pivots 25*a*, 25*b*, 26*a*, 26*b* is constituted by a cylindrical magnet 28 that is arranged axially with respect to a sleeve 29 that protrudes from a footing 30 that can be associated with the profiles 31*a*, 31*b*.

The sleeves 29 are selectively and slideably arrangeable inside the jackets 24*a*, 24*b* of the rectilinear hollow bodies 8*a*, 8*b*.

Operation of the device is the following: after coupling the rectilinear hollow bodies 8*a*, 8*b* to the entrainers 10*a*, 10*b* and thus to the respective first trolleys 11*a*, 11*b* and to the second trolleys 14*a* and 14*b*, starting from the condition in which the door leaves are closed, shown in FIG. 1, when a door leaf is opened, for example the outer door leaf 2*a*, the rectilinear hollow body 8*a* disengages from the first stroke limiting magnetized pivot 25*a* and then engages with the second magnetized pivot 25*b*.

In this manner the magnet 28 interacts with the jacket 24*a*, slowing down the movement of the rectilinear hollow body 8*a* and loading the springs 23*a*, 23*b*.

The use of a magnet makes it possible to use a constant force both when closing and when opening.

The magnet 28 thus makes it possible to attract the jacket 24*a*, until a stroke limit is reached, in an optimal and continuous manner.

In practice it has been found that the invention has fully achieved the intended aim and objects, a device being obtained that can be applied to sliding doors or door leaves, including existing doors or door leaves, and is provided with a simple structure that, partly thanks to the use of magnets, is free from sticking, thus making it possible to achieve the optimal guided closing and opening of the door or of the door leaf while preventing the same from slamming on the wall of the piece of furniture.

Furthermore, the weight and dimensions and cost of the device are contained, while at the same time making it possible to contain the friction and elements of play in the various movements, so as to optimize the movement and the sliding of the door leaf Obviously the materials used as well as the dimensions of the individual components of the invention may be more relevant according to specific requirements.

The various means of achieving certain different functions certainly need not coexist only in the embodiment shown, but may be present in many embodiments, even if not shown.

The characteristics indicated above as advantageous, convenient or similar, may also be missing or be substituted by equivalent characteristics.

The disclosures in Italian Patent Application No. TV2013A000072 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A damping or return device for sliding door leaves, particularly for furniture, comprising:

a rectilinear hollow body made of plastic material, which is slideably associated with a profile that is integral with a top of a piece of furniture and can be coupled automatically and with a snap action to an entrainer that is fixed to one of the door leaves by way of a carriage, the rectilinear hollow body accommodating a bidirectional shock absorber and interacting selectively with a first or a second magnetized stroke limiting pivot which are associated with a first guide or with a second guide, wherein the rectilinear hollow body has an upper profile that is shaped, in a side view, substantially like an upturned V so as to define two inclined planes, at a vertex there being a first seat within which a shaft that protrudes transversely with respect to the entrainer can be coupled with a snap action.

2. The device according to claim 1, wherein the piece of furniture is constituted by two sides, a top and inner and outer door leaves, which lie on mutually parallel planes and mutually overlap, a first guide for the outer door leaf on the top and a second guide, which is parallel to the first guide and is arranged proximate to a front perimetric edge of the top, for the inner door leaf, the device being associated with each one of the door leaves, the profile being arranged in a region that is intermediate between the first and second guides or the profile being arranged in a region that is adjacent to the first guide in a direction that is opposite with respect to the front perimetric edge.

3. The device according to claim 1, wherein the rectilinear hollow body comprises a first rectilinear hollow body that can be coupled automatically and with a snap action to the entrainer that is fixed to the outer door leaf by way of a first carriage that is constituted by a metallic bracket that is substantially U-shaped, one of its wings being coupled proximate to the end of the inner side wall of the outer door leaf, a first wheel being associated rotatably with another wing and sliding at the first guide, a second carriage being coupled proximate to the opposite end of the inner side wall of the outer door leaf, a second wheel being associated rotatably with another wing and sliding at the first guide.

4. The device according to claim 3, wherein the rectilinear hollow body comprises a second rectilinear hollow body that can be coupled automatically and with a snap action to another entrainer that is fixed to the inner door leaf by way of a first carriage, the latter being constituted by a substantially U-shaped metallic bracket of which one wing is coupled proximate to the end of the inner side wall of the inner door leaf, a first wheel being associated rotatably with the other wing and sliding at the second guide, a second carriage being coupled proximate to the opposite end of the inner side wall of the inner door leaf and a second wheel being associated rotatably with another wing and sliding at the second guide.

5. The device according to claim 1, wherein the bidirectional shock absorber has a pair of hollow deceleration cylinders that are connected axially by a pivot which is partially and slideably associated therein and has a disk interposed at a centerline between a facing end of the deceleration cylinders, and the bidirectional shock absorber has a cylindrical helical compression spring, the dimensions of the bidirectional shock absorber being such that, at rest, the deceleration cylinders protrude slightly beyond the ends of the rectilinear hollow body.

6. The device according to claim 5, wherein a metallic jacket is associated coaxially with the deceleration cylinders and in turn is arranged coaxially to the ends of the rectilinear hollow body.

7. The device according to claim 2, wherein the first magnetized pivot and the second magnetized pivot are associated with the profile that is arranged in the region that is intermediate between the first and second guides, the first magnetized pivot and the second magnetized pivot being associated with the profile that is arranged in the region that is adjacent to the first guide in the direction that is opposite with respect to the front perimetric edge.

8. The device according to claim 4, wherein the first and second stroke limiting magnetized pivots are arranged in axial alignment with the first rectilinear hollow body, while the first and second magnetized stroke limiting pivots are arranged in axial alignment with the second rectilinear hollow body, the first and second magnetized stroke limiting pivots being associated so that one is proximate to a lateral end of the piece of furniture and another one is at a point that makes it possible to achieve a condition in which the door leaf is moved.

9. The device according to claim 7, wherein each one of the first and second magnetized pivots is constituted by a cylindrical magnet that is arranged axially with respect to a sleeve that protrudes from a footing that can be associated with the profiles, the sleeves being arrangeable selectively and slideably within the rectilinear hollow body.

10. A damping or return device for sliding door leaves, particularly for furniture, comprising:

a rectilinear hollow body made of plastic material, which is slideably associated with a profile that is integral with a top of a piece of furniture and can be coupled automatically and with a snap action to an entrainer that is fixed to one of the door leaves by way of a carriage;

a bidirectional shock absorber accomodated by the rectilinear hollow body and interacting selectively with a first or a second magnetized stroke limiting pivot which are associated with a first guide or with a second guide, wherein the bidirectional shock absorber has a pair of hollow deceleration cylinders that are connected axially by a pivot which is partially and slideably associated therein and has a disk interposed at a centerline, between a facing end of the deceleration cylinders, and the bidirectional shock absorber having a cylindrical helical compression spring, the dimensions of the bidirectional shock absorber being such that, at rest, the deceleration cylinders protrude slightly beyond the ends of the rectilinear hollow body.

11. The device according to claim 10, wherein a metallic jacket is associated coaxially with the deceleration cylinders and in turn is arranged coaxially to the ends of the rectilinear hollow body.

12. The device according to claim 10, wherein the piece of furniture is constituted by two sides, a top and inner and outer door leaves, which lie on mutually parallel planes and mutually overlap, a first guide for the outer door leaf on the top and a second guide, which is parallel to the first guide and is arranged proximate to a front perimetric edge of the top, for the inner door leaf, the device being associated with each one of the door leaves, the profile being arranged in a region that is intermediate between the first and second guides or the profile being arranged in a region that is adjacent to the first guide in a direction that is opposite with respect to the front perimetric edge.

13. The device according to claim 12, wherein the first magnetized pivot and the second magnetized pivot are associated with the profile that is arranged in the region that is intermediate between the first and second guides, the first magnetized pivot and the second magnetized pivot being associated with the profile that is arranged in the region that is adjacent to the first guide in the direction that is opposite with respect to the front perimetric edge.

14. The device according to claim 13, wherein each one of the first and second magnetized pivots is constituted by a cylindrical magnet that is arranged axially with respect to a sleeve that protrudes from a footing that can be associated with the profiles, the sleeves being arrangeable selectively and slideably within the rectilinear hollow body.

15. The device according to claim 10, wherein the rectilinear hollow body comprises a first rectilinear hollow body that can be coupled automatically and with a snap action to the entrainer that is fixed to the outer door leaf by way of a first carriage that is constituted by a metallic bracket that is substantially U-shaped, one of its wings being coupled proximate to the end of the inner side wall of the outer door leaf, a first wheel being associated rotatably with another wing and sliding at the first guide, a second carriage being coupled proximate to the opposite end of the inner side wall of the outer door leaf, a second wheel being associated rotatably with another wing and sliding at the first guide.

16. The device according to claim 15, wherein the rectilinear hollow body comprises a second rectilinear hollow body that can be coupled automatically and with a snap action to another entrainer that is fixed to the inner door leaf by way of a first carriage, the latter being constituted by a substantially U-shaped metallic bracket of which one wing is coupled proximate to the end of the inner side wall of the inner door leaf, a first wheel being associated rotatably with the other wing and sliding at the second guide, a second carriage being coupled proximate to the opposite end of the inner side wall of the inner door leaf and a second wheel being associated rotatably with another wing and sliding at the second guide.

17. The device according to claim 16, wherein the first and second stroke limiting magnetized pivots are arranged in axial alignment with the first rectilinear hollow body, while the first and second magnetized stroke limiting pivots are arranged in axial alignment with the second rectilinear hollow body, the first and second magnetized stroke limiting pivots being associated so that one is proximate to a lateral end of the piece of furniture and another one is at a point that makes it possible to achieve a condition in which the door leaf is moved.

18. A damping or return device for sliding door leaves, particularly for furniture, comprising:

a rectilinear hollow body made of plastic material, which is slideably associated with a profile that is integral with a top of a piece of furniture and can be coupled automatically and with a snap action to an entrainer that is fixed to one of inner and outer door leaves by way of a carriage, the rectilinear hollow body accommodating a bidirectional shock absorber and interacting selectively with a first or a second magnetized stroke limiting pivot which are associated with a first guide or with a second guide, wherein the piece of furniture is constituted by two sides, a top and inner and outer door leaves, which lie on mutually parallel planes and mutually overlap, a first guide for the outer door leaf on the top and a second guide, which is parallel to the first guide and is arranged proximate to a front perimetric edge of the top, for the inner door leaf, the device being associated with each one of the door leaves, the profile being arranged in a region that is intermediate between the first and second guides or the profile being arranged in a region that is adjacent to the first guide in a direction that is opposite with respect to the front perimetric edge, wherein the first magnetized pivot and the second magnetized pivot are associated with the profile that is arranged in the region that is intermediate between the first and second guides, the first magnetized pivot and the second magnetized pivot being associated with the profile that is arranged in the region that is adjacent to the first guide in the direction that is opposite with respect to the front perimetric edge, wherein each one of the first and second magnetized pivots is constituted by a cylindrical magnet that is arranged axially with respect to a sleeve that protrudes from a footing that can be associated with the profiles, the sleeves being arrangeable selectively and slideably within the rectilinear hollow body.

19. The device according to claim 18, wherein the rectilinear hollow body comprises a first rectilinear hollow body that can be coupled automatically and with a snap action to the entrainer that is fixed to the outer door leaf by way of a first carriage that is constituted by a metallic bracket that is substantially U-shaped, one of its wings being coupled proximate to the end of the inner side wall of the outer door leaf, a first wheel being associated rotatably with another wing and sliding at the first guide, a second carriage being coupled proximate to the opposite end of the inner side wall of the outer door leaf, a second wheel being associated rotatably with another wing and sliding at the first guide.

20. The device according to claim 19 wherein the rectilinear hollow body comprises a second rectilinear hollow body that can be coupled automatically and with a snap action to another entrainer that is fixed to the inner door leaf by way of a first carriage, the latter being constituted by a substantially U-shaped metallic bracket of which one wing is coupled proximate to the end of the inner side wall of the inner door leaf, a first wheel being associated rotatably with the other wing and sliding at the second guide, a second carriage being coupled proximate to the opposite end of the inner side wall of the inner door leaf and a second wheel being associated rotatably with another wing and sliding at the second guide.

* * * * *